United States Patent [19]

Metz et al.

[11] 4,392,281

[45] Jul. 12, 1983

[54] RELEASABLE FASTENER

[75] Inventors: Joseph R. Metz, Ridgefield; Michael F. Barnes, Sandy Hook, both of Conn.

[73] Assignee: Norco, Inc., Ridgefield, Conn.

[21] Appl. No.: 232,097

[22] Filed: Feb. 6, 1981

[51] Int. Cl.[3] ..... A43C 11/08; A44B 13/00

[52] U.S. Cl. ..... 24/230.5 R; 24/230.5 AD; 24/230.5 W; 292/111; 52/127.9

[58] Field of Search ..... 292/111, 116, 120, 101; 52/127.7, 127.9; 24/230.5 R, 230.5 AD

[56] References Cited

U.S. PATENT DOCUMENTS

| | | | |
|---|---|---|---|
| 320,729 | 6/1885 | Walker | 24/230.5 AD |
| 3,191,244 | 6/1965 | Burke | 52/127.9 |
| 3,309,115 | 3/1967 | Langer | 52/584 |
| 3,484,832 | 12/1969 | Langer | 292/111 |
| 3,528,690 | 9/1970 | Langer | 52/584 |
| 3,661,410 | 5/1972 | Larson et al. | 52/127.9 |
| 3,712,653 | 1/1973 | Lehmann | 52/584 |
| 4,020,613 | 5/1977 | Reynolds et al. | 52/127.9 |
| 4,021,064 | 5/1977 | Kruzan et al. | 292/111 |

FOREIGN PATENT DOCUMENTS

| | | | |
|---|---|---|---|
| 562189 | 11/1957 | Belgium | 292/111 |

*Primary Examiner*—Gene Mancene
*Assistant Examiner*—Paul S. Polakowski
*Attorney, Agent, or Firm*—H. Gibner Lehmann; K. Gibner Lehmann

[57] ABSTRACT

A releasable, hook-type fastener of the kind intended to secure pieces of equipment or structural members together, the fastener including a casing, a drive shaft turnable in the casing, an eccentric bushing carried by the casing and turnable with the shaft, and a pair of separate and distinct, similarly-shaped spring hooks that are disposed side by side and substantially in broadside contact with each other. At one end, the hooks have looped bearing portions which are frictionally engaged with the eccentric bushing, and at the other end they have registered bill portions. A pin is provided, separate from the hooks and adjacent to the eccentric bushing, for engagement with the hooks so as to maintain them in registration with one another. The arrangement is such that an unusually strong and sturdy construction results, without the need for heavy gauge springs and without the use of odd-shaped springs which would require special metal stock and bending fixtures or jigs for their fabrication.

13 Claims, 15 Drawing Figures

RELEASABLE FASTENER

BACKGROUND

This invention relates generally to releasable fasteners of the type intended to secure two pieces of equipment or structural members together. More particularly, the present invention involves improvements in the fastener constructions illustrated and described in U.S. Pat. Nos. 3,309,115; 3,484,832; 3,528,690 and 3,712,653.

The devices shown in all of the above patents incorporate spring-type hook members which are associated with eccentric bushings of one form or another, such that when the bushing is turned, the spring on one panel or member is carried toward a fixed abutment or pin on the other of the members, and thereafter shifted laterally of the abutment so as to draw it inwardly toward the axis of the bushing, thereby locking the members together.

U.S. Pat. No. 3,528,690 involves a single S-shaped hook which accomplishes the desired locking. The remaining three patents identified above disclose devices employing not only simple S-shaped hooks but also more complicated arrangements and configurations entailing double hooks of relatively complex shape, these being bent from a single piece of wire stock. An example of such a complex hook is illustrated in FIG. 9 of U.S. Pat. No. 3,712,653. In addition, FIGS. 1 and 2 of U.S. Pat. No. 3,309,115 illustrate a different configuration of spring hook. Finally, FIGS. 10 and 11 of U.S. Pat. No. 3,484,832 show a still different design for a one-piece spring hook.

While the various arrangements disclosed in the above patents functioned in an acceptable manner for some purposes, several disadvantages become apparent. Where a single S-shaped hook was employed, the mechanism lacked strength and rigidity for all applications. That is, a single hook of relatively small gauge wire was in some cases not sufficiently stiff. Attempts to overcome this problem by employing a larger gauge wire resulted in increased cost, and more difficulty in bending and forming the wire to the desired shape, particularly where the wire was of spring-type stock.

In construction employing a double spring that was constituted as a single piece, problems arose in fabricating the part in an inexpensive manner. The multiple bends that were required were difficult to impart to the piece, and special fixtures or bending jigs had to be devised in order to generate the complex shapes.

Finally, several of the arrangements shown in the prior patents have been found to be expensive to make from the manufacturing standpoint, since it was difficult to assemble the various parts properly. Moreover, with complex mechanisms it has been found to be difficult to realize reliable operation over extended periods of use. Poor reliability was especially troublesome in installations where it was mandatory that the devices operate in their intended manner and with no malfunctioning due to jamming, binding, seizure or breakage of the individual parts.

SUMMARY

The above disadvantages and drawbacks of prior releasable fastener mechanisms are obviated by the present invention, which has for one object the provision of an improved hook-type fastener which is especially simple in construction, rugged in use, and dependable in operation, particularly over extended periods of time.

Yet another object of the invention is the provision of a fastener as above characterized which has an especially strong and sturdy arrangement of parts, thus reducing the likelihood of failure over the useful life of the device.

Still another object of the invention is to provide a fastener in accordance with the foregoing, which is constituted of relatively simple structural members that are capable of being fabricated without special fixtures, tools or the like.

A still further object of the invention is to provide a fastener as outlined above, which can be readily assembled by virtue of its simplicity, and with a minimum of time and effort.

Yet another object of the invention is to provide a fastener as characterized which is virtually fool-proof in operation, and which is especially adapted to have a long life expectancy.

The above objects are accomplished by a releasable hook-type fastener, comprising a drive shaft and means for turnably mounting the shaft on equipment which requires fastening, an eccentric bushing turnable with the shaft, and a pair of separate and distinct, similarly-shaped spring hooks disposed side-by-side and substantially in broadside contact with one another, the hooks having looped bearing portions frictionally and slidably engaged with the eccentric bushing and having laterally-registered bill portions. Also, means are provided, separate and distinct from the hooks and held captive adjacent the eccentric bushing, engageable with the hooks so as to maintain them in registration with one another at all times.

The arrangement is such that the hooks can be fabricated from relatively small gauge, stiff wire stock that lends itself to bending without the use of special heavy-duty bending jigs or fixtures; in addition, the hooks are constituted as simple S-shaped parts, involving no unusual bends that would require special wire forming equipment for their fabrication.

The registration means preferably is in the form of a simple pin which engages the ends of the looped bearing portions of the hooks, such an arrangement having been found to be especially economical from the manufacturing standpoint, all without sacrificing strength or reliability of operation, particularly over extended periods of use.

Most or all of the individual parts of the fastener are constituted as simple metal stampings which can be readily assembled by riveting, or other simple fastening arrangements. Extreme economy is thus had, without jeopardizing reliability, or freedom from jamming or malfunction.

Other features and advantages will hereinafter appear.

In the drawings, illustrating a preferred embodiment of the invention:

Figure 1:
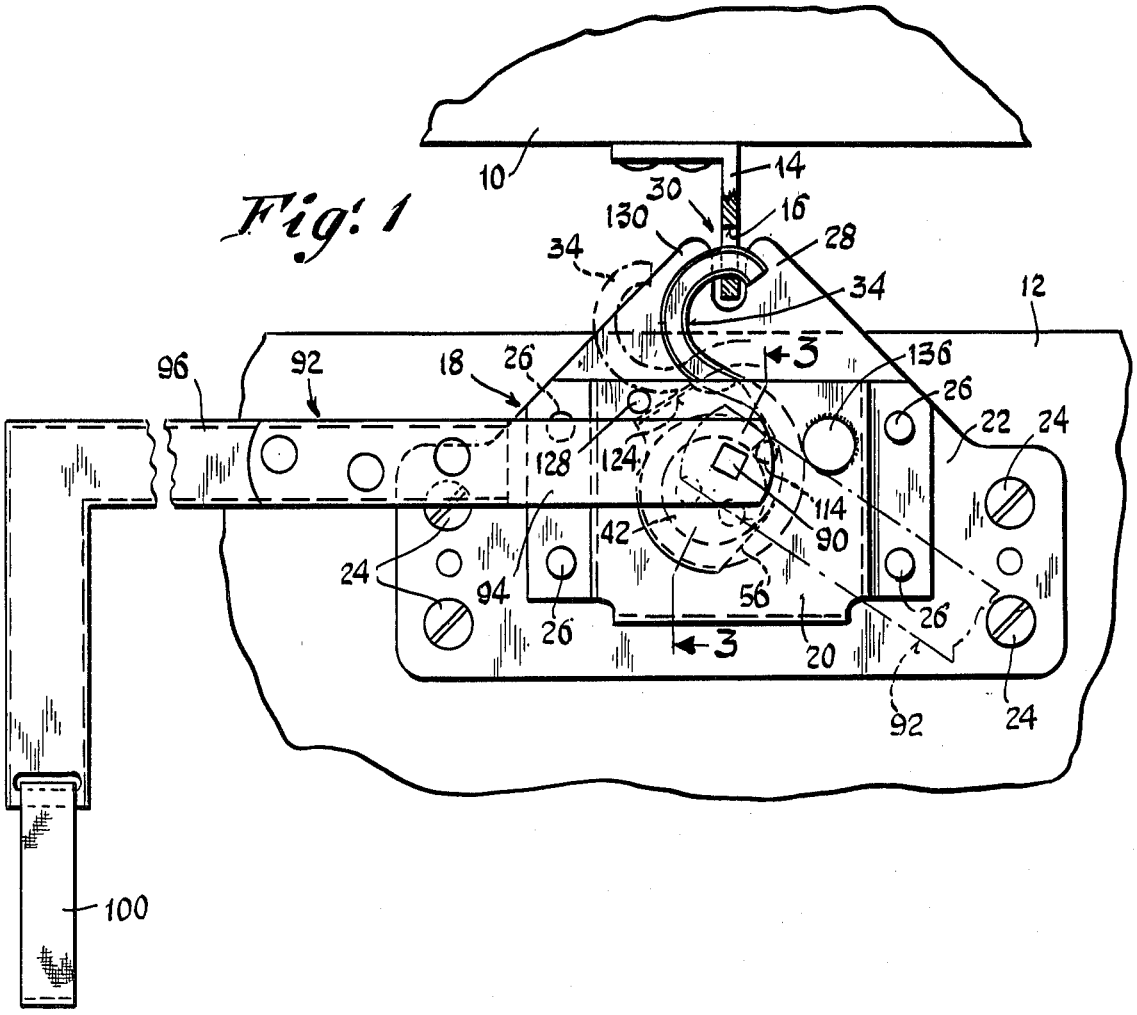
FIG. 1 is a front elevational view of the releasable, hook-type fastener of the present invention, shown securing two pieces of equipment together.
Figure 2:
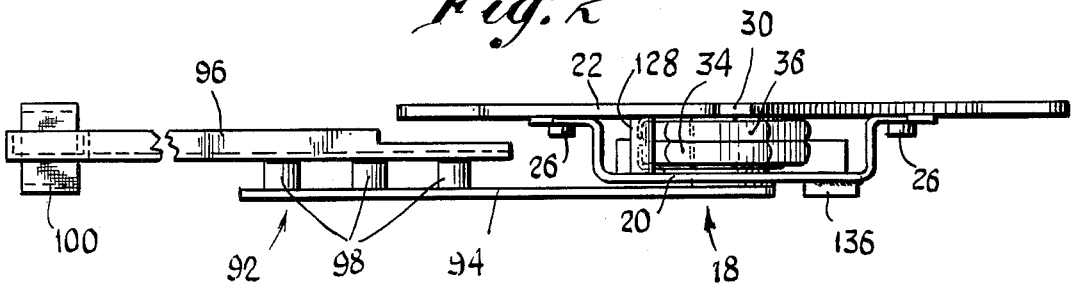
FIG. 2 is a top plan view of the fastener of FIG. 1.
Figure 3:
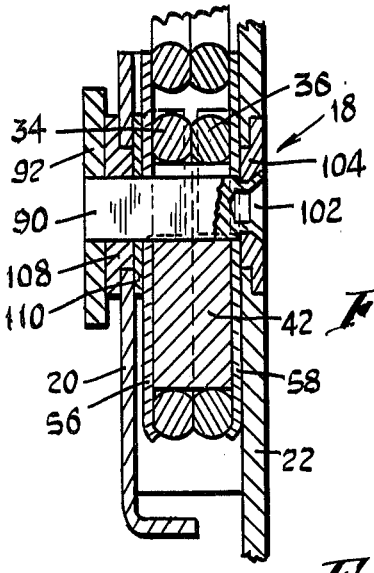
FIG. 3 is a section taken on the line 3—3 of FIG. 1.

Referring to FIGS. 1–3, there is illustrated a releasable, hook-type fastener for securing together two pieces of equipment or two structural members, designated 10 and 12. The member 10 has secured to it a latch member in the form of an angle bracket 14, having a hole 16 which is adapted to receive a spring hook portion of the fastener, to be described below.

The fastener is generally designated by the numeral 18 and is particularly shown in FIGS. 1–3. The fastener comprises a casing having front and rear mounting plates or casing parts 20, 22, the latter being secured to the structure 12 by means of multiple screws 24. The front casing part 20 is secured to the rear casing part 22 by multiple rivets 26. The casing part 22 has an extremity portion 28 with a cut-out or notch 30 that is adapted to receive the angle bracket 14 in the manner shown in FIG. 1.

Figure 13:
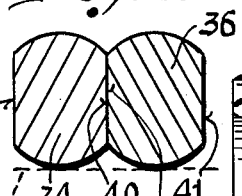
FIG. 13 is a section taken on the line 13—13 of FIG. 4.
Figure 4:
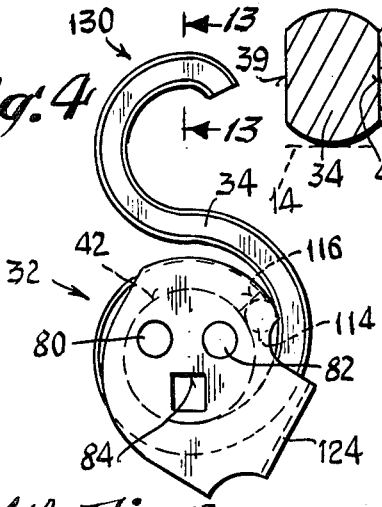
FIG. 4 is a front elevational view of an assembly comprising a pair of spring hooks disposed side-by-side, and a pair of actuator plates associated therewith, this assembly constituting part of the fastener of FIG. 1.
Figure 5:
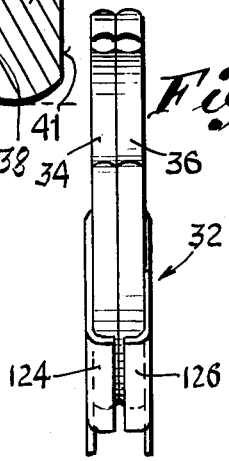
FIG. 5 is a right side elevational view of the assembly of FIG. 4.
Figure 6:
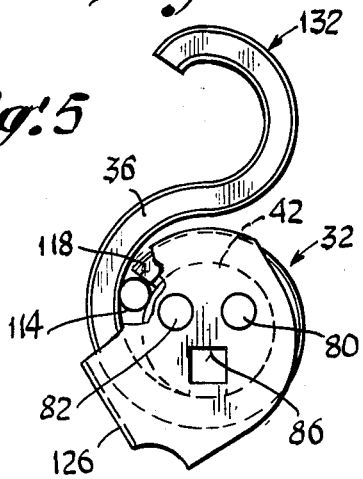
FIG. 6 is a rear elevational view of the assembly of FIG. 4, particularly showing in end elevation, a pin which operates to maintain the spring hooks in registration with one another.
Figure 14:
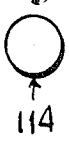
FIG. 14 is an end elevational view of the registration pin shown in assembly of FIG. 6.
Figure 15:
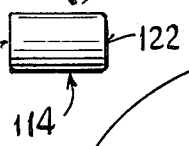
FIG. 15 is a side elevational view of the pin.

In accordance with the present invention there is provided a novel assembly generally designated by the numeral 32 and particularly illustrated in FIGS. 4–6, the assembly being disposed between the casing parts 20 and 22 and adapted for swivelling movement so as to move a hook structure thereof between first and second portions, respectively illustrated in solid outline and dotted outline in FIG. 1. The assembly 32 comprises a pair of separate and distinct spring hooks 34, 36, constituted of relatively heavy, stiff wire stock. As particulary illustrated in FIG. 13 and by the present invention, the facing portions 38, 40 of the hooks 34, 36 are flatted, so as to enable them to closely abut one another along substantially their entire lengths.

Figure 9:
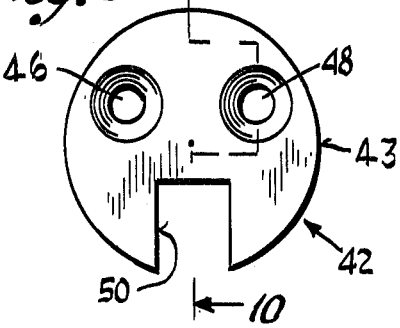
FIG. 9 is a front elevational view of an eccentric bushing associated with the assembly of FIG. 4, particularly illustrating a non-circular notch adapted to be keyed to a square drive shaft of the fastener.
Figure 10:
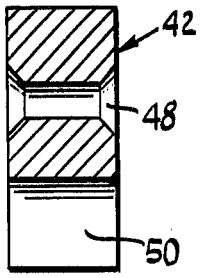
FIG. 10 is a section taken on the line 10—10 of FIG. 9.
Figure 11:
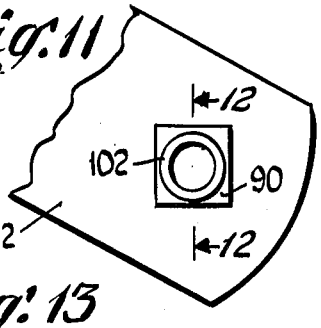
FIG. 11 is a rear elevational view of the operating arm of the mechanism of FIG. 1, particularly illustrating the square drive shaft carried thereon.
Figure 7:
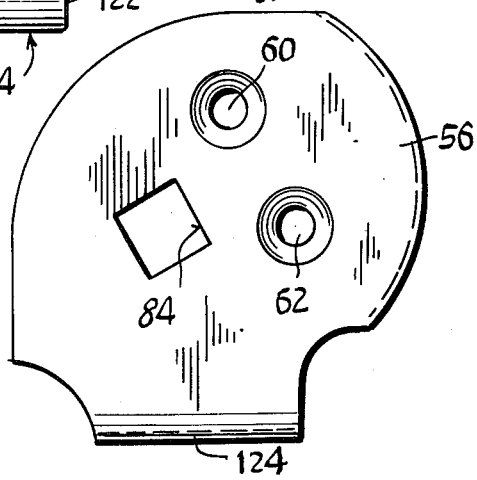
FIG. 7 is a front elevational view, enlarged, of one of the actuator plates of the assembly of FIG. 4.
Figure 8:
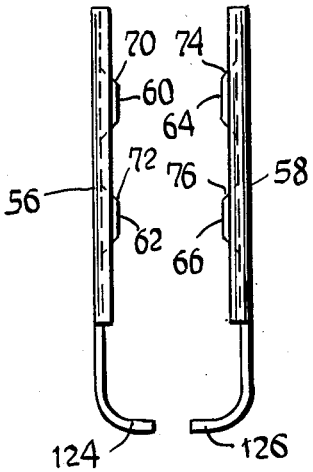
FIG. 8 is an end elevational view, enlarged, of both actuator plates associated with the assembly of FIG. 4.

Referring again to FIGS. 4–6, there is disposed within the looped bearing portions of the hooks 34, 36 a cylindrical bushing 42 having a cylindrical bearing surface 43, particularly shown in FIGS. 9 and 10. The bushing 42 has mounting holes 46, 48, and a notch 50 of non-circular outline, intended to receive a square drive shaft and to be keyed thereto, as will be described below. The bushing is positioned inside the looped bearing portions of the hooks 34, 36, as indicated by the dotted outlines in FIGS. 4 and 6, and is held captive therein by means of a pair of actuator plates 56, 58, particularly shown in FIGS. 7 and 8. The plates 56, 58 sandwich the bushing 42, and overlap virtually all of the looped bearing portions of the hooks 34, 36 as shown in FIGS. 4 and 6. The plate 56 has holes 60, 62, with the plate 58 having holes 64, 66, the respective pairs of holes being intended to align with one another and with respective holes 46, 48 of the bushing 42. As shown, surrounding the holes 60–66 are dimpled formations 70, 72, and 74, 76, which are intended to be received in the countersunk formations surrounding the holes 46, 48 of the bushing 42, these being shown in FIGS. 9 and 10. Rivets 80, 82 secure the plates 56, 58 rigidly to the bushing 42, with the looped bearing portions of the hooks 34, 36 held captive as in FIGS. 4–6.

Figure 12:
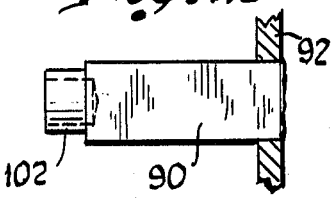
FIG. 12 is a section taken on line 12—12 of FIG. 11.

The actuator plates 56, 58 have square openings 84, 86 respectively which are aligned with the notch 50 of the bushing 42 such that the assembly consisting of the hooks 34, 36, bushing 42, and plates 56, 58 can be turnably actuated by means of a square drive shaft 90 that is shown in FIGS. 3 and 12. Carried on the end of the shaft 90 is a manually operable actuator arm 92 which, in the illustrated embodiment, is shown as being constituted of two parts 94 and 96. These are secured together by means of multiple spacers 98 that are preferably riveted in place. Disposed at the end of the part 96 is a finger engageable member 100, which can be in the nature of a nylon strap formed into a loop.

Referring again to FIG. 3, the square drive shaft 90 has a circular bearing portion 102 which is received in a bearing 104 carried in the casing part 22. The bearing portion 102 is hollow, and swaged over a seat of the bearing 104 as in FIG. 3, so as to hold captive the shaft 90. That part of the shaft 90 which is adjacent the arm 92 is supported on a bearing 108 which is pressed into the casing part 20. A spacer washer 110 is disposed between the part 20 and the actuator plate 56.

Further in accordance with the present invention, there is provided a novel arrangement for maintaining the hooks 34, 36 in registration with one another, in the form of a registration pin 114 which may be in the form of a bar of solid wire stock, placed in position at the ends 116, 118 of the hooks 34, 36. The opposite ends 120, 122 of the pin are engaged and held by the actuator plates 56, 58. The pin 114 is merely dropped into position prior to the assembly of these plates to the bushing 42. FIG. 6 shows the plate 58 partially broken away, so as to illustrate the position of the pin 114.

With the above arrangement, there exists a frictional engagement between the cylindrical bearing portion 43 of the bushing 42, and the inner surfaces of the loop portions of the hooks 34, 36, such that the latter can turn a limited extent with respect to the bushing 42 and plates 56, 58, the latter three parts being rigid with one another and moving together as a unit.

Referring again to FIGS. 4, 6, and 8, it can be seen that the plates 56, 58 have angularly disposed shoulders 124, 126 which are intended to engage the hooks 34, 36 when the bushing 42 and plates 56, 58 have been turned in a clockwise direction in FIGS. 1 or 4, past a certain point. This has the effect of positively locking the hooks in the solid line positions of FIG. 1 when the manually operable arm 92 is swung to the full clockwise position also shown in this figure as being in solid outline.

Referring again to FIGS. 1 and 2, there is provided a stop shoulder 128 in the form of a pin or rivet, extending between the casing part 20 and casing part 22. This pin 128 limits the swinging movements of the hooks 34, 36 in a counterclockwise direction to the position illustrated in dotted outline in FIG. 1. Accordingly, the hooks 34, 36 can swing between a first position shown in solid outline in FIG. 1, wherein the bill or end portions extend through the opening 16 in the bracket 14, and a second position wherein the bill portions of the hooks engage the stop pin 128. In FIGS. 4 and 6 these bill portions are indicated by the numerals 130 and 132. As can be readily understood from FIG. 13, the hooks 34, 36 engage the wall of the hole 16 at spaced apart points thereon, resulting in a sturdier retention of the bracket 14 than would be the case were a single, larger diameter hook employed.

In operation, the swiveling movement of the hooks 34, 36 is accomplished by swinging of the arm 92 between first and second positions, illustrated respectively in solid outline and dotted outline in FIG. 1. It can be seen in FIG. 1 that the bushing 42 rotates about an axis passing through the center of the square shaft 90, such axis being non-coincidental with the axis of symmetry of the bushing. Accordingly, when the arm 92 is swung from the position illustrated in dotted outline in FIG. 1, in a clockwise direction, not only do the hooks 34, 36 swing in a clockwise direction during the initial travel of the arm 92, but in addition as the arm reaches its final position as shown in solid outline in FIG. 1, the holes 34, 36 are pulled laterally downward in FIG. 1, by virtue of the eccentric mounting or disposition of the bushing 42 with respect to the axis of the drive shaft 90. Accordingly, the bracket 14 is urged toward the extremity portion 28, and securely held in place. As the arm 92 reaches its final horizontal position, the shoulders 124, 126 of the actuator plates 56, 58 engage the bill portions 130, 132 of the hooks 34, 36 respectively as in FIG. 1, so as to positively drive the hooks home wherein they extend completely through the opening 16.

In FIG. 1, there is provided an additional stop shoulder 136 in the form of a pad or land that is welded to the casing part 20. This land is engaged by the arm 92 when the latter is swung in a counterclockwise direction in FIG. 1. The engagement of this land 136 and the arm 92 is shown in dotted outline in FIG. 1.

It is noted that in FIG. 1, the relative positions of the bushing 42 and actuator plates 56, 58 are shown in dotted outline. These positions correspond to those which would be occupied by the hooks 34, 36 when they are in the locking position, in solid outline in FIG. 1, wherein they have been shifted downwardly by the eccentric action of the bushing 42. It can be further seen that for this position, the bushing 42 has passed a dead center location with respect to the axis of the shaft 90, such that any force that is applied to the hooks 34, 36 in an upward direction in FIG. 1 cannot cause a counterclockwise rotation of the bushing 42 and plates 56, 58 and conceivably result in an inadvertent release of the equipment 10. Such would not be the case were the bushing 42 not disposed in a position past dead center when the arm 92 is fully clockwise.

From the above it can be seen that we have provided an especially strong and sturdy releasable, hook-type fastener which is both rugged in use and reliable in operation particularly over extended periods of time. The individual parts are simple in construction, and can be readily fabricated with a minimum of time and effort by virtue of the fact that most are in the form of metal stampings. As a result, the overall manufacturing cost can be kept low.

The provision of two spring hooks which are disposed side-by-side results in unusual strength, and yet retains the advantage of simplicity and eliminates the need for using wire stock of unusually heavy gauge. Since the hooks have a relatively simple configuration in the shape of the letter S, no special materials or heavy gauge stock are required, nor are the use of special bending fixtures needed, as was the case with many of the devices of the prior art that employed hooks of relatively complex shape.

The provision of the single registration pin 114 has been found to be a highly satisfactory solution to the problem of maintaining the positions of the hooks 34, 36 in registration with one another. In this connection it is noted that pin 114 is neither welded nor cemented in place, merely being held between the actuator plates 56 and 58, when the latter are riveted to the bushing 42. Accordingly, by this particular arrangement there is realized an economy from the manufacturing standpoint.

The device is thus seen to represent a distinct advance and improvement in the technology of releasable fasteners.

Each and every one of the appended claims defines an aspect of the invention distinct from the others, and accordingly each claim is to be treated in this manner when examined in light of the prior art, in any determination of novelty or validity.

Variations and modifications are possible without departing from the spirit of the invention.

We claim:

1. In a releasable, hook-type fastener, in combination:

(a) a drive shaft, (b) means for turnably mounting said shaft on equipment which requires fastening, (c) an eccentric bushing turnable with said shaft, (d) a pair of separate and distinct, similarly-shaped spring hooks disposed side-by-side and substantially in broadside contact with each other, having looped bearing portions frictionally and slidably engaged with the eccentric bushing and having laterally-registered coextensive bill portions aligned with each other and directed in the same direction, and (e) means separate from said spring hooks and held captive thereby and disposed adjacent the eccentric bushing, said means being engageable and movable with said hooks to continually maintain the same in registration with one another.

2. The invention as defined in claim 1, wherein:

(a) the adjacent facing portions of said hooks have flats, to enable the hooks to fit broadside one against the other.

3. The invention as defined in claim 1, and further including:

(a) a pair of separate and distinct actuator plates disposed on opposite ends of said eccentric bushing, (b) means for securing said plates to the bushing such that the assemblage can move as a unit, (c) said actuator plates having shoulder portions respectively engageable with said spring hooks for locking the same in latching position when the eccentric bushing is disposed in a predetermined rotative position with respect to said shaft mounting means.

4. The invention as defined in claim 1, wherein:

(a) said means for maintaining the spring hooks in registration comprises a pin extending alongside and parallel to the axis of the eccentric bushing, (b) said pin being engageable with ends of said spring hooks.

5. The invention as defined in claim 1, wherein:

(a) said eccentric bushing has a notch disposed in its periphery and extending parallel to the axis of the bushing, (b) said drive shaft extending through said notch and being keyed to the bushing.

6. The invention as defined in claim 1, wherein:

(a) said notch in the eccentric bushing is of non-circular cross-sectional configuration, (b) said drive shaft having a non-circular cross-sectional configuration mating with the configuration of the notch in the bushing.

7. The invention as defined in claim 1, wherein:

(a) said spring hooks are constructed of heavy and stiff, resilient wire stock, and the looped bearing portions thereof are inwardly biased to frictionally bear with controlled slippage on the said bushing.

8. The invention as defined in claim 1, wherein:

(a) said means for turnably mounting the shaft comprises a casing having bearings in which the shaft is mounted, (b) said casing having means for attaching it to said equipment.

9. The invention as defined in claim 1, and further including:

(a) a manually operable arm rigidly affixed to said drive shaft and extending in a direction laterally away therefrom, and (b) a finger engageable member secured to the end of the manually operable arm and adapted to be actuated by finger pressure applied thereto.

10. The invention as defined in claim 8, and further including:

(a) a stop shoulder carried by said casing and adapted for engagement by said spring hooks to limit the retracting movement thereof after the latter have been shifted to an unlocking position.

11. The invention as defined in claim 9, and further including:

(a) a stop shoulder carried by the said casing and engageable with said manually operable arm to limit the unlatching movement of the same.

12. In a releasable, hook-type fastener, in combination:

(a) a drive shaft, (b) means for turnably mounting said shaft on equipment which requires fastening, (c) an eccentric bushing turnable with said shaft, and (d) a pair of separate and distinct, similarly-shaped spring hooks disposed side by side and substantially in broadside contact with each other, having looped bearing portions frictionally and slidably engaged with the eccentric bushing, and having laterally-registered coextensive bill portions aligned with each other and directed in the same direction, (e) the adjacent, facing portions of said hooks having flats, said hooks fitting broadside to and continuously engaging one another, (f) a latch member adapted to be mounted on other equipment and to be releasably retained by said hooks, (g) said hooks providing increased strength over that which would be realized were a single hook of the same dimension employed, and said hooks providing a pair of spaced-apart points of contact with said latch member, resulting in a more reliable construction that is less likely to fail under extreme conditions of use.

13. The invention as set forth in claim 1, wherein:

(a) said spring hooks are constituted of relatively stiff wire stock of partially circular cross section.

* * * * *